US008434889B2

(12) United States Patent
Sommers et al.

(10) Patent No.: US 8,434,889 B2
(45) Date of Patent: May 7, 2013

(54) LIGHTED DISPLAY CASE HAVING REDUCED GLARE

(75) Inventors: Mathew Sommers, Sagamore Hills, OH (US); William David Sekela, Aurora, OH (US); Mark Edward Kaminski, Tucson, AZ (US)

(73) Assignee: GE Lighting Solutions, LLC, Cleveland, OH (US)

( * ) Notice: Subject to any disclaimer, the term of this patent is extended or adjusted under 35 U.S.C. 154(b) by 416 days.

(21) Appl. No.: 12/727,422

(22) Filed: Mar. 19, 2010

(65) Prior Publication Data

US 2011/0228519 A1 Sep. 22, 2011

(51) Int. Cl.
*A47F 11/10* (2006.01)
*F21V 1/00* (2006.01)

(52) U.S. Cl.
USPC ..... 362/125; 362/235

(58) Field of Classification Search ..... 362/125, 362/600, 235, 217.01, 133, 249.01, 294, 362/127

See application file for complete search history.

(56) References Cited

U.S. PATENT DOCUMENTS

| | | | | |
|---|---|---|---|---|
| 5,050,047 | A | 9/1991 | Viner et al. | |
| 6,550,269 | B2 | 4/2003 | Rudick | |
| 7,410,275 | B2 | 8/2008 | Sommers et al. | |
| 7,497,600 | B2 | 3/2009 | Sekela et al. | |
| 2002/0109980 | A1 * | 8/2002 | Santosuosso et al. | 362/92 |
| 2005/0265019 | A1 * | 12/2005 | Sommers et al. | 362/217 |
| 2007/0266723 | A1 * | 11/2007 | Lee et al. | 62/264 |
| 2008/0186695 | A1 * | 8/2008 | Awai et al. | 362/92 |
| 2008/0186696 | A1 * | 8/2008 | Awai et al. | 362/92 |
| 2008/0186732 | A1 * | 8/2008 | Awai et al. | 362/609 |
| 2008/0285264 | A1 | 11/2008 | Whitehouse et al. | |

FOREIGN PATENT DOCUMENTS

WO WO 2008/097496 8/2008

* cited by examiner

*Primary Examiner* — Anh Mai
*Assistant Examiner* — Elmito Breval
(74) *Attorney, Agent, or Firm* — Fay Sharpe LLP

(57) ABSTRACT

A retail display case includes a case, retail product supports in the case, and a plurality of substantially point light sources in the case. Light sources located at or near eye level of a consumer of typical height throw light at an angle from horizontal and toward retail products in the case.

21 Claims, 3 Drawing Sheets

FIG. 3
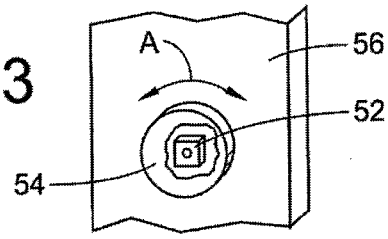
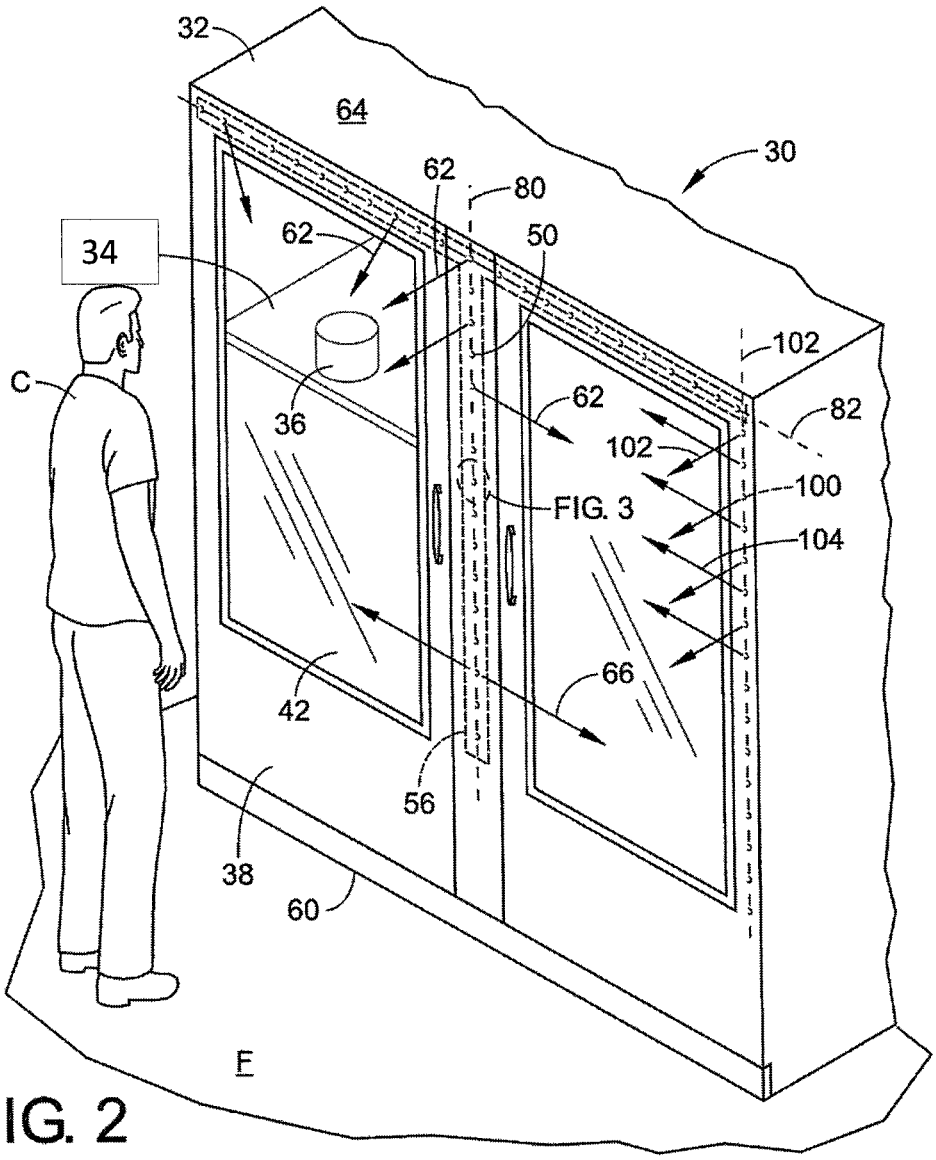
FIG. 2

LIGHTED DISPLAY CASE HAVING REDUCED GLARE

BACKGROUND

Lighting systems are used to illuminate display cases, such as commercial refrigeration units, as well as other display cases that need not be refrigerated. Typically, a fluorescent tube is used to illuminate products disposed in the display case. Fluorescent tubes do not have nearly as long a lifetime as a typical LED. Furthermore, for refrigerated display cases, initiating the required arc to illuminate a fluorescent tube is difficult in a refrigerated compartment.

Light emitting diodes have also been used to illuminate display cases. Known lighting systems for retail display cases that use vertically oriented point light sources, e.g. light emitting diodes ("LEDs") disposed along a vertical axis, to illuminate products in the display case typically throw light in an angular distribution pattern along the horizontal direction. FIG. 1 depicts a customer C of typical height, e.g. between about 5 feet to about 6 and ½ feet, standing on a viewing surface, which can be the floor F adjacent a display case 10. LEDs 12 (depicted schematically—the LEDs would not be visible from outside of the case) direct light in a generally horizontal direction to illuminate retail products 16 supported on shelves 18 (only one product and one shelf shown for clarity) in the display case.

As LEDs have become more powerful and able to generate more light, it has been found to be desirable to reduce the number of LEDs used to illuminate a retail display case. Since LEDs typically have higher luminance (intensity per unit area) than fluorescent sources, and since LEDs are typically used in conjunction with optics to emit into a narrow beam pattern, this can result in challenges to overcome.

Light that impinges on products 16 having a glossy finish specularly reflects off of the glossy surface. Specular reflection is where the angle of incidence of the light ray with respect to a normal surface of the product 16 is equal to the angle of reflection. If a customer's C eyes are in the path of the specularly reflected light rays, then the customer sees a glare on the product surface. This obscures the customer's view of the products in the display case, which is undesirable.

SUMMARY

A lighting system that overcomes the aforementioned shortcomings includes a plurality of substantially point light sources arranged generally along a vertical axis, a first optic cooperating with a first light source of the plurality of point light sources and a second optic cooperating with a second light source of the plurality of point light sources. The first optic and the first light source can be disposed vertically above the second optic and the second light source. The first optic can be configured to direct light emanating from the first light source in a more vertical direction as compared to the direction that the second optic is configured to direct light emanating from the second light source.

In a retail display case having retail product supports, e.g. hangers or shelves, in the case for supporting retail products for display in the case, a lighting system that overcomes the aforementioned shortcomings can include a plurality of substantially point light sources and an optic cooperating with each light source. The light sources can be arranged generally along a vertical axis. The optics cooperating with the light sources located about four and one-half feet to about six and one-half feet above the lowermost surface of the case can be configured to direct light from the respective light sources toward a vertical plane in the case that is near an outermost edge of the retail product supports such that light rays specularly redirected by an associated retail product that is adjacent to the vertical plane are directed vertically away from eye level of a consumer of typical height who is standing about one foot from a display case.

Another example of a lighting system that can overcome the aforementioned shortcomings includes a plurality of upper substantially point light sources, a plurality of lower substantially point light sources, a plurality of upper optics, and a plurality of lower optics. Each point light source can be arranged generally along a vertical axis. Each upper optic can be associated with an upper light source of the plurality of upper light sources. Each lower optic can be associated with a lower light source of the plurality of lower light sources. At least one of the upper optics can direct light from the respective upper light source in a more vertical direction than at least one of the lower optics directs light from the respective lower light source.

Another example of a lighting system for use in a display case where the display case extends from below a horizontal field of view of a typical viewer to at least the horizontal field of view of the typical viewer can include product supports in the display case for supporting products in the case for display to the typical viewer and can include a first plurality of substantially point light sources and first optical elements. The first plurality of substantially point light sources can be arranged generally along a vertical axis and can extend along a substantial portion of the height of the display case. Each first optical element can cooperate with a respective first plurality of light source to direct light from each of the plurality of lights sources in a predetermined direction. Light from the first plurality of light sources arranged generally along the vertical axis below the horizontal field-of-view of the typical viewer can be directed in a substantially horizontal direction, and light from the first plurality of light sources arranged generally along the vertical axis above a lower boundary of the horizontal field-of-view of the typical viewer can be directed in an off-horizontal angular direction.

BRIEF DESCRIPTION OF THE DRAWINGS

FIG. 2 is a schematic depiction of a display case including a novel lighting system.

FIG. 3 is a close-up view of a portion of the lighting system shown in FIG. 2.

DETAILED DESCRIPTION

Figure 1:
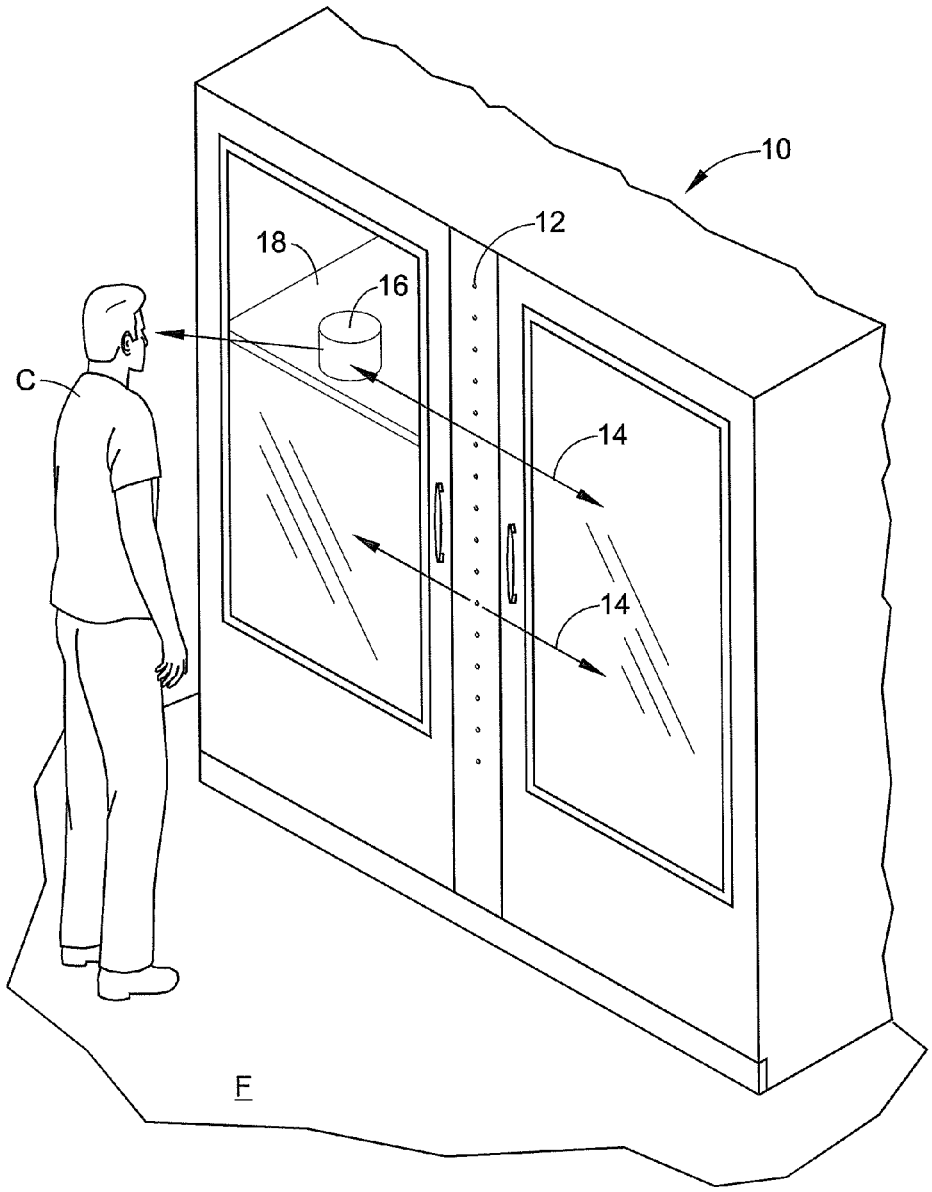
FIG. 1 (PRIOR ART)
FIG. 1 is a schematic depiction of a display case including a known lighting system.

With reference to FIG. 2, a lighting system 28 that is useful in reducing glare when displaying retail products is depicted in a display case 30. The display case 30 includes a case 32 and retail product supports 34 in the case for supporting retail products 36 for display in the case. FIG. 2 depicts a particular example of a retail display case, which is a refrigerated display case, that includes doors 38 having glass panels 42 that allow the consumer C to see what is inside the case. The retail product supports 34 shown in FIG. 2 are shelves upon which the retail products 36 rest. Hangers, baskets and other support structures that can support retail products can also be disposed in the display case to support retail products for display within the case. Similar types of retail display cases are described in U.S. Published Patent Application Publication No. 2005/0265019, published Dec. 1, 2005, the entirety of which is herein incorporated by reference.

A plurality of substantially point light sources 50 (depicted schematically in FIG. 2, the point light sources are not visible from outside the case 32) are disposed in the case 32. The point light sources in the depicted embodiment are light emitting diodes ("LEDs") 52 (FIG. 3) which make up the lighting system 28 that illuminates the inside of the case 32. The lighting system 28 in the depicted embodiment includes the LEDs 52 and can also include optics, or optical elements, 54 (FIG. 3) that cooperate with a respective LED. For example, each light source 50 shown in FIG. 2 can include an LED that cooperates with its own optic. Alternatively, multiple LEDs can cooperate with a single optic. FIG. 3 depicts one example of a lighting system 28 where a surface mounted LED 52 cooperates with a refractive optic 54, but other types of LEDs and other optics, such as reflective optics, can also be used. With reference to FIG. 3, both the optic 54 and the LED 52 are shown mounted to a support, which is a printed circuit board ("PCB") 56. The PCB includes circuitry (not shown) for delivering electrical energy to the LEDs so that the LEDs emit light. The PCB can mount to the case 32, for example through a heat sink (not shown) or other frame structure to which the PCB attaches. With continued reference to FIG. 2, the lighting system 28 is shown mounted to a mullion 58, which is a vertically extending component of the case 32 between the doors 38. The lighting system can also mount to the case 32 above the uppermost retail product support 34.

The optic 54 can be fixed on the PCB 56 such that the optic is not movable with respect to the respective LED 52. Alternatively, the optic 54 can be movable with respect to the LED 52 and the PCB 56. For example, the optic 54 can attach to the PCB 56 in a manner that allows rotation of the optic, for example in the directions designated by arrow A in FIG. 3. This can allow for field adjustment of the optic 54 with respect to the LED 52 to allow for optimal performance with difference case configurations. This can also optimize performance where various shelf and basket sizes or hangers are used in the display case for supporting the retail products within the display case. Moreover, the LED devices 52 can be multiple color temperature devices (multi-CCT LED). By utilizing multi-CCT LEDs, the light output from these devices can be effectively mixed to customize the final color temperature within the case. By removing the possibility of specular glare into a typical consumer's eye, the direct view of LEDs with individual CCTs do not show as hot spots on products having a glossy finish.

To overcome the problems associated with light specularly reflecting off products having a glossy finish, which results in an undesirable glare if the specularly reflected light ray is within the path of a consumer's eye, in one example at least substantially all of the light sources located at or near eye level of a typical consumer throw light downward from horizontal and toward the retail product supports, e.g. the shelves 34. For example, assuming a typical customer is about 5 feet to about 6½ feet tall, eye level for the typical customer is a few inches below 5 feet to about a few inches below 6½ feet. Another way to refer to this is that a typical customer's horizontal field of view is about 5 feet to about 6 and one-half feet above a viewing surface, which can be the floor F upon which the display case 32 is supported. Accordingly, each light source 50 that is about eye level from a lowermost surface 60 of the case 32 can be associated with a respective optic that is configured to direct light from the respective light source in an off-horizontal angular direction, e.g. a downward diagonal direction toward the retail product shelves 34. This is depicted in FIG. 2 with light rays 62 from the light sources 50 near the top 64 of the case. This off-horizontal angular direction can be about 10° from horizontal to about 90° from horizontal.

The direction of the light rays 62 is depicted in a vertical plane that is substantially parallel to the glass panel 42 and/or a plane near an outermost edge of the shelves or other retail product supports 34 found in the case. Even if there is specular glare off of the retail product 36, since the angle of incidence of a light ray 62 with respect to the retail product at eye level is downward, the angle of reflection of this light ray is further downward and away from the typical consumer's eyes. In another example, each light source that is about 4 feet to about 7 feet from the lowermost surface 60 of the case 32 can be associated with a respective optic that is configured to direct light from the respective light source in a diagonal (downward or upward) direction toward the shelves 34.

The light sources 52 that are located nearer the bottom of the case 32 are configured to direct light in a generally horizontal direction toward the retail products 36 as depicted by light rays 66, which are depicted in the same vertical plane as light rays 62. This is similar to conventional retail display cases, but since the specular path is not towards a typical consumers head, the consumer sees no specular glare for products located in the lower part of the case while the product is still adequately illuminated. A more particular example is that light sources 50 that are less than about 4 feet from the lowermost surface 60 of the case 32 are configured to direct light in a generally horizontal direction toward the retail product supports.

Another way of overcoming the problem of specular glare is to have the optics 54 associated with light sources 52 located nearer the top 64 of the case 32 direct light from the respective light source at an angle that is closer to vertical as compared to the optics that are associated with light sources located nearer the bottom of the case. Compare, for example, light rays 62 to light rays 66. In the example shown in FIG. 2, the products located near the top 64 of the display case 32 are illuminated by light sources that are disposed above the uppermost shelf (retail product support) 34 in the case 32. Accordingly, the plurality of light sources 52 in the case can include light sources disposed generally along a first (vertical) axis 80 and light sources disposed generally along a second (horizontal) axis 82, which is at least substantially perpendicular to the first axis. The light sources need not be located exactly on the vertical axis 80 or the horizontal axis 82 and could be offset and/or staggered. To provide this configuration, the PCB 56, which operates as a support, can be either T-shaped or L-shaped. The light sources 50, e.g. the LEDs 52 associated optics 54, above the uppermost shelf 34 direct light vertically downwardly to illuminate products 36 in the display case 32 that are generally at eye level for a typical consumer, e.g. about 5 feet to about 6 feet above the floor or lowermost surface 60 of the case 32. The light sources 52 along the first vertical axis 80 that are disposed at about eye level for a typical consumer direct light downwardly and toward the center of the case.

In another example of a lighting system for a retail display case, light sources 100, which can include the LED 52 and the optic 54 disclosed in FIG. 3, disposed along a vertical axis 102 can alternate throwing light up and down so that retail products are evenly illuminated but any specular glare is directed above and below the consumer's view. For example, some of the light sources direct light in a downward diagonal direction, as depicted by light rays 102, and some of the light sources direct light in an upward diagonal direction, as shown by light rays 104. Care can be taken so that light sources 100 that are at about eye level from the bottommost surface 60 of the case 32 direct light so that much of any specular reflection from the light is directed above or below the consumer's view.

Figure 4:
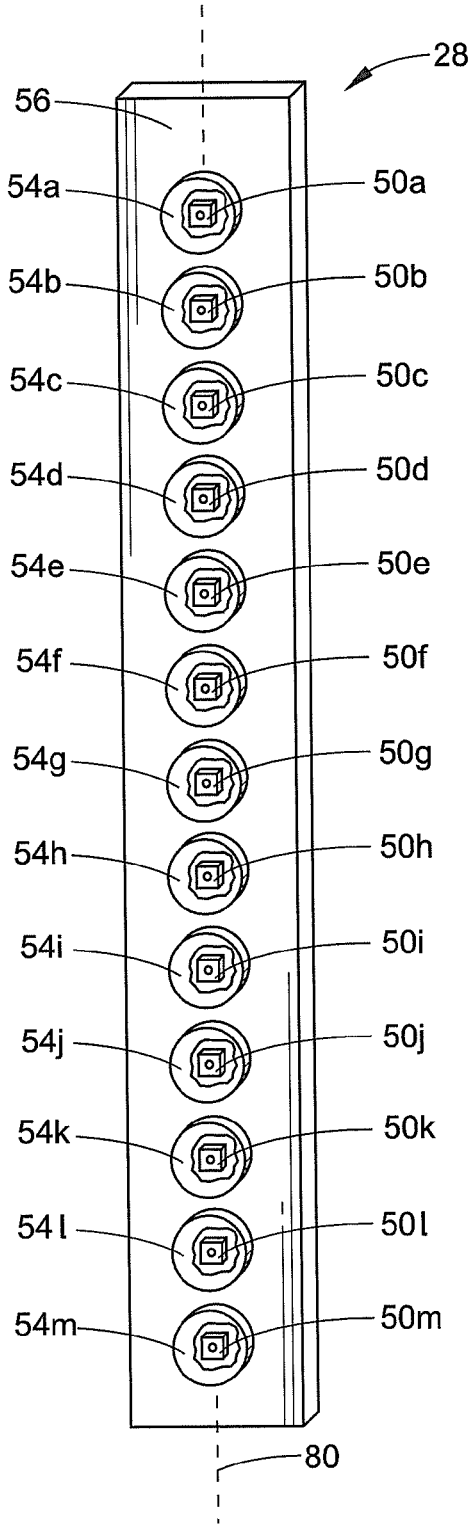
FIG. 4 is a perspective view of a lighting system for illuminating a display case including a plurality of point light sources and cooperating optics. The optics are shown broken away so that the light sources are visible.

With reference to FIG. 4, the lighting system 28 is shown including the plurality of substantially point light sources 50*a*-50*m* and the cooperating optics 50*a*-50*m* mounted to the PCB 56. Point light sources are arranged generally along a vertical axis 80 and more particular to the embodiment shown in the FIG. 4, each light source is intersected by the vertical axis. As described above, the light sources could be offset from the vertical axis if desired.

With regard to how the optics and the point light sources can operate, as an example, a first optic 54*a* cooperates with a first light source 50*a* of the plurality of point light sources and a second optic, for example, the optic 54*h* cooperates with a second light source 50*h* of the plurality of point light sources. The first optic 54*a* and the first light source 50*a* are disposed vertically above the second optic 54*h* and the second light source 50*h*. The first optic 54*a* is configured to direct light emanating from the first light source 50*a* in a more vertical (downward or upward) direction (see FIG. 2) as compared to the direction that the second optic 54*h* is configured to direct light emanating from the second light source 50*h* (see FIG. 2). As mentioned above, each point light source can be an LED.

As another example, a first set of light sources 50*a*, 50*b*, 50*c*, which make up a portion of the plurality of light sources can be disposed vertically above a second set of light sources 50*h*, 50*i*, 50*j*. A first set of optics 54*a*, 54*b*, 54*c* can each cooperate with a respective first set light source 50*a*, 50*b*, 50*c*. Also, a second set of optics 54*h*, 54*i*, 54*j* can cooperate with a respective second set light source 50*h*, 50*i*, 50*j*. Each first set optic 54*a*, 54*b*, 54*c* can be configured to direct light emanating from the respective first set light 50*a*, 50*b*, 50*c* in a more vertical (downward or upward) direction (see FIG. 2) as compared to the direction that each second set optic 54*h*, 54*i*, 54*j* is configured to direct light emanating from the respective second set light source 50*h*, 50*i*, 50*j*. Moreover, each second set optic 54*h*, 54*i*, 54*j* can be configured to direct light in the same angular direction (see FIG. 2). The first optics, the first point light sources, the second optics and the second light sources described above are simply examples. Each set can include a greater or a fewer number of components and each set can be located elsewhere on the PCB 56.

With reference back to FIG. 2, it can be desirable that the optics cooperating with light sources located less than about three feet from the lowermost surface 60 of the case 30 are configured to direct light from the respective light sources 50 all in the same general angular direction such as that shown in FIG. 2. This is because if light emanating from these lower light sources is specularly reflected off of products, e.g. retail product 36, that are located below the eye level of a consumer of typical height the reflected light rays will not bounce back into the eyes of the consumer of typical height resulting in undesirable glare. Because of this, the optics cooperating with light sources located about four and one-half feet to about six and one-half feet above the lowermost surface 60 of the case 30 can be configured to direct light from the respective light sources toward a vertical plane in the case 30 that is near an outermost edge of the retail product supports 34 such that light rays specularly redirected by a retail product 36 that is adjacent to the vertical plane are directed vertically away from the eye level of a consumer C of typical height standing about one foot from the display case. By directing the light rays in such a manner, the specular reflection off of the products near eye level of the consumer of typical height is minimized and the retail products in the display case can be more easily viewed. It is desirable that the light sources be aimed to provide generally uniform illuminance across the vertical plane that is near an outermost edge of the retail product supports 34. It is also desirable to aim the light sources to reduce or minimize the illuminance of reflected light in a vertical plane that is offset outside of the case about one foot from the door 38 in a band defined between about 5 feet above the ground to about 6 and one-half feet above the ground upon which the case rests.

With reference back to FIG. 4, the lighting system 18 can be considered to include a plurality of upper substantially point light sources, e.g. point light sources 50*a*-50*d* and a plurality of lower substantially point light sources, e.g. point light sources 50*j*-50*m*. The lighting system can also be considered to include a plurality of upper optics 54*a*-54*d*, each upper optic being associated with an upper light source of the plurality of upper light sources. The lighting system 28 can also include a plurality of lower optics 50*j*-50*m*, each lower optic being associated with a lower light source 50*j*-50*m* of the plurality of lower light sources. At least one of the upper optic 54*a*-54*d* can direct light from the respective upper light source 50*a*-50*d* in a more vertical direction than at least one of the lower optics 54*j*-54*m* from the respective lower light source 50*j*-50*m*. Moreover, each of the upper optics 54*a*-54*d* can direct light from the respective upper light source 50*a*-50*d* in a more vertical (upward or downward) direction than at least one of the lower optics 54*j*-54*m* directs light from the respective lower light source 50*j*-50*m*. Alternatively, each of the upper optics 54*a*-54*d* can direct light from the respective upper light source 50*a*-50*d* in a more vertical direction than each of the lower optics 54*j*-54*m* directs light from the respective lower light source 50*j*-50*m*. When the lighting system 28 is disposed within a display case the plurality of upper substantially point light sources can include light sources disposed about five feet and about six and one-half feet from a lowermost support surface (for example support surface 60 in FIG. 3) of the case.

With reference to FIGS. 2 and 4, the lighting system 28 can be used in a display case 30 where the display case extends from below a horizontal field of view of a typical viewer, e.g. about 4 and one-half feet to about 6 and one-half feet above a viewing surface, which can be the floor F upon which the display case 32 is supported. The display case can extend to at least the horizontal field of view of the typical viewer and include product supports 34 for supporting products in the display case 30 for display to the typical viewer. The lighting system can include a first plurality of substantially point light sources, e.g. light sources 50*a*-50*m*, arranged generally along a vertical axis extending along a substantial portion of the height of the display case. Optical elements, e.g. optics 54*a*-54*m*, can cooperate with each of the first plurality of light sources 50*a*-50*m* to direct light from the light sources in a predetermined direction. For example, light from the light sources arranged generally along the vertical axis 80 below the horizontal field of view, e.g. light from light sources 50*h*-50*j* in FIG. 4, can be directed in a substantially horizontal direction (e.g. about 0° with respect to horizontal). Light from the light sources arranged generally along the vertical axis 80 above a lower boundary of the horizontal field of view, e.g. light from light sources 50*b*-50*e*, can be directed in an off-horizontal angular direction, e.g. about 10° to about 90° from horizontal in either an upward or a downward direction. Light from the light sources arranged generally along the vertical axis above the lower boundary of horizontal field of view of the typical viewer can increases in off-horizontal angular direction the further up the vertical axis the light sources are arranged. With reference to FIG. 2, the lighting system 28 can also include a second plurality of point light sources arranged generally along a horizontal axis extending along a substantial portion of the width of the display case 32 near the top of the display case. Optical elements, e.g. optics 54, cooperating with each of the second plurality of light sources can direct light from the second plurality of light sources in a predetermined direction such that light from the second plurality of light sources is directed generally downwardly from the horizontal axis.

A lighting system for retail display cases has been described with reference to the particular embodiments. Modifications and alterations will occur to those skilled in the art upon reading and understanding the preceding detailed description. It is intended that the invention be construed as including all such modifications and alterations insofar as they come within the scope of the appended claims or the equivalents thereof.

The invention claimed is:

1. A lighting system comprising:

a plurality of substantially point light sources arranged generally along a vertical axis;

a first optic cooperating with a first light source of the plurality of point light sources; and a second optic cooperating with a second light source of the plurality of point light sources;

wherein the first optic and the first light source are disposed vertically above the second optic and the second light source;

wherein the first optic is configured to direct light emanating from the first light source in a more vertical direction as compared to the direction that the second optic is configured to direct light emanating from the second light source.

2. The lighting system of claim 1, wherein the light sources include LEDs.

3. The lighting system of claim 1, wherein each light source is disposed along the vertical axis.

4. The lighting system of claim 1, further comprising:

a first set of light sources, which make up a portion of the plurality of light sources;

a second set of light sources, which make up a portion of the plurality of light sources;

a first set of optics, each first set optic cooperating with a respective first set light source;

a second set of optics, each second set optic cooperating with a respective second set light source;

wherein the first set of light sources are disposed vertically above the second set of light sources;

wherein each first set optic is configured to direct light emanating from the respective first set light source in a more vertically downward direction as compared to the direction that each second set optic is configured to direct light emanating from the respective second set light source.

5. The lighting system of claim 4, wherein each second set optic is configured to direct light in the same angular direction.

6. The lighting system of claim 1, further comprising at least one support, the point light sources being mounted on the at least one support and the optics being connected with the at least one support.

7. The lighting system of claim 6, wherein the each optic is movable with respect to the respective light source.

8. The lighting system of claim 6, wherein each optic is fixed with respect to the respective light source.

9. The lighting system of claim 1, further comprising a further plurality of substantially point light sources arranged generally along a horizontal axis.

10. The lighting system according to claim 1, wherein the plurality of substantially point light sources are arranged on a printed circuit board.

11. In a retail display case having retail product supports in the case for supporting retail products for display in the case, a lighting system for the case comprising:

a plurality of substantially point light sources arranged generally along a vertical axis; and an optic cooperating with each light source, wherein the optics cooperating with light sources located about four and one-half feet to about six and one-half feet above the lowermost surface of the case are configured to direct light from the respective light sources toward a vertical plane in the case that is near an outermost edge of the retail product supports such that light rays specularly redirected by an associated retail product that is adjacent to the vertical plane are directed vertically away from eye level of a consumer of typical height standing about one foot from the display case.

12. The lighting system of claim 11, further comprising a plurality of substantially point light sources arranged generally along a horizontal axis above a door of the display case.

13. The lighting system of claim 12, further comprising a T-shaped or L-shaped support supporting the light sources.

14. The lighting system of claim 11, wherein each light source is intersected by the vertical axis.

15. The lighting system of claim 11, wherein the optics cooperating with light sources located less than about three feet from the lowermost surface of the case are configured to direct light from the respective light sources all in the same general angular direction.

16. A lighting system for use in a display case, the display case extending from below a horizontal field of view of a typical viewer to at least the horizontal field of view of the typical viewer and including product supports in the display case for supporting products in the case for display to the typical viewer, the lighting system comprising:

a first plurality of substantially point light sources arranged generally along a vertical axis and extending along a substantial portion of the height of the display case; and a first optical element cooperating with each of the first plurality of light sources to direct light from each of the plurality of lights sources in a predetermined direction such that light from the first plurality of light sources arranged generally along the vertical axis below the horizontal field of view of the typical viewer is directed in a substantially horizontal direction, and light from the first plurality of light sources arranged generally along the vertical axis above a lower boundary of the horizontal field of view of the typical viewer is directed in an off-horizontal angular direction.

17. The lighting system of claim 16, wherein the horizontal field of view of the typical viewer is about four and one-half feet to about six and one-half feet above a viewing surface.

18. The lighting system of claim 17, wherein the viewing surface is the surface on which the display case is supported.

19. The lighting system of claim 16, wherein light from the first plurality of light sources arranged generally along the vertical axis above the lower boundary of the horizontal field of view of the typical viewer increases in off-horizontal angular direction further up the vertical axis the light sources are arranged.

20. The lighting system of claim 16, wherein the off-horizontal angular direction is between about 10° from horizontal to about 90° from horizontal.

21. The lighting system of claim 16 further comprising:

a second plurality of substantially point light sources arranged generally along a horizontal axis extending along a substantial portion of the width of the display case near the top of the display case, and a second optical element cooperating with each of the second plurality of light sources to direct light from the second plurality of lights sources in a predetermined direction such that light from the second plurality of light sources is directed downwardly from the horizontal axis.

* * * * *